US005782193A

United States Patent [19]

Schwarzberger et al.

[11] Patent Number: 5,782,193

[45] Date of Patent: Jul. 21, 1998

[54] VERTICAL STITCHING MACHINE AND METHOD

[76] Inventors: Michael V. Schwarzberger, 7401 N. Albany, Chicago, Ill. 60645; Neal A. Schwarzberger; Joseph C. Podolski, both of 205 Alpine Dr., Vernon Hills, Ill. 60061

[21] Appl. No.: 805,455

[22] Filed: Feb. 25, 1997

[51] Int. Cl.[6] ..... D05B 21/00

[52] U.S. Cl. ..... 112/470.13; 112/117; 112/475.08

[58] Field of Search ..... 112/83, 470.12, 112/470.13, 117, 118, 119, 475.01, 475.08, 475.17

[56] References Cited

U.S. PATENT DOCUMENTS

| | | | |
|---|---|---|---|
| 4,557,206 | 12/1985 | Iwase | 112/470.13 |
| 5,103,747 | 4/1992 | Resta et al. | 112/470.13 X |
| 5,287,820 | 2/1994 | Stutznacker | 112/470.13 X |
| 5,325,802 | 7/1994 | Stutznacker | 112/117 |
| 5,333,561 | 8/1994 | Katou | 112/470.13 |
| 5,410,974 | 5/1995 | Henz et al. | 112/83 |
| 5,497,719 | 3/1996 | Henz et al. | 112/83 |
| 5,503,092 | 4/1996 | Aubourg et al. | 112/470.13 X |

*Primary Examiner*—Paul C. Lewis
*Attorney, Agent, or Firm*—Charles F. Lind

[57] ABSTRACT

The disclosed stitching machine and method orients cooperating needle and hook components of a sewing machine in spaced horizontal alignment, and suspends flexible sheet(s) to be stitched in a generally vertical orientation between these sewing machine components, and tensions the sheet(s) to a flat stitchable condition whereby the sewing machine components might stitch interior seams through the flexible sheet(s). Horizontal and vertical slides support the cooperating sewing machine components to move along horizontal and vertical axes parallel to the suspended flexible sheet(s), and controlled drives shift them in unison along these axes as needed to trace out an intended seam pattern relative to the flexible sheet(s). A conveyor is provided with a substantially vertical run of a height in excess of the sheet(s) to be stitched when vertically oriented, to pass the sheets between the sewing machine components and hold them in the vertical orientation for stitching, and to remove them after being stitched. The disclosed invention reduces floor space previously needed for prior art stitching machines that oriented the flexible sheet(s) in a horizontal plane when being stitched.

13 Claims, 3 Drawing Sheets

VERTICAL STITCHING MACHINE AND METHOD

BACKGROUND OF THE INVENTION

The common bed quilt typically will have a mat or equivalent fill of lightweight open-cell or porous material sandwiched between more durable and/or attractive cloth or fabric sheets. Such quilts can be commercially made by initially seaming the layered components together at the perimeters, and then by sewing or stitching them together along patterned seams spaced inwardly from the perimeters. Other products having layered cloth or fabric sheets without any sandwiched fill, or even a single sheet can also have related interior patterned seams or stitchings for holding the sheets together and/or for merely decorative purposes.

Most commercial machines for quilting or stitching fabric sheets utilize a perimeter frame to which the flexible sheet(s) when stretched flat could be clamped. The sheet frame, while aligned horizontally, would then be manipulated to position its clamped sheet(s) between the opposed upper or needle head and lower hook or base components of a sewing machine, which would stitch through the sheet(s) to complete the patterned interior seams. To accommodate this, perpendicularly arranged "X" axis and "Y" axis guide tracks are provided for the sheet frame and/or sewing machine, suited thereby upon specific combinations of relative "X" axis and "Y" axis movements between the sheet frame and sewing machine for generating the desired patterned seams.

One such type of stitching machine has the vertically separated and opposed needle head and base components of the sewing machine horizontally stationary, and the sheet frame and clamped sheet(s) only are moved horizontally along "X" and "Y" axes relative to and between the opposed operating sewing machine components to trace out the patterned seams on the clamped sheet(s). However, to provide complete patterned seam coverage over most of the sheet interior, the guide track and/or frame structure and/or clearance space for actual sheet frame movements need be extended horizontally to approximately four times the size of the sheet frame. An improved type of stitching machine further provides that the opposed sewing machine head and base components are moved in unison alone the "X" axis or side to side of the sheet frame, reducing the size requirements of the stitching machine frame by almost one-half while yet being approximately twice the size of the sheet frame. Another improved type of stitching machine further moves the sewing machine alone the "Y" axis or lengthwise of the sheet frame, reducing the size requirements of the stitching machine again by almost one-half but yet being more than the sheet frame itself.

Thus, as the clamped sheet(s) are stretched out to full size and are oriented horizontally when being stitched in most if not all existing interior seam stitching machines, such stitching machines require floor space larger than the flexible sheet goods or quilt itself, and frequently several times larger than this minimum size. Moreover, additional floor space at least as large as the sheet frame is typically needed for supporting the sheet frame when it is outside of the stitching machine, as when the flexible sheet(s) is clamped to or removed from the sheet frame.

SUMMARY OF THE INVENTION

This invention relates to a machine for and method of stitching interior patterned seams on flexible fabric sheet goods, specifically including on quilts.

A basis object of this invention is to provide an improved stitching machine and its method of stitching that greatly reduces the needed floor space requirements therefor, compared to prior art stitching machines.

A specific feature of the invention is an improved method of stitching flexible sheet(s) along interior patterns or seams spaced from the perimeter of the sheet(s), which comprises having the sheet(s) oriented substantially vertically during such stitching. The working tool or stitching machine is guided along the "X" or horizontal axis and "Y" or vertical axis, in a controlled manner dictated by conventional drives and controls. The vertical orientation of the work piece or sheet(s) allows for a stitching machine to practice the method with frame width requirements comparable to the width of the sheet(s) being stitched, but less than and virtually independent of the length of the sheet(s) being stitched, reducing the otherwise horizontal floor space requirements of such stitching machine.

Another specific feature of the invention is to provide a horizontally compact stitching machine and conveyor therefor, suited to move the sheet(s) to be stitched through the machine and past the sewing machine components to then be operated automatically by conventional controls, yielding a stitching machine and method that can be practiced by less than a full-time operator, meaning that one operator will be able to handle the work demands of several like simultaneously operated stitching machines clustered around the operator.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF A PREFERRED EMBODIMENT OF THE INVENTION

Figure 1:
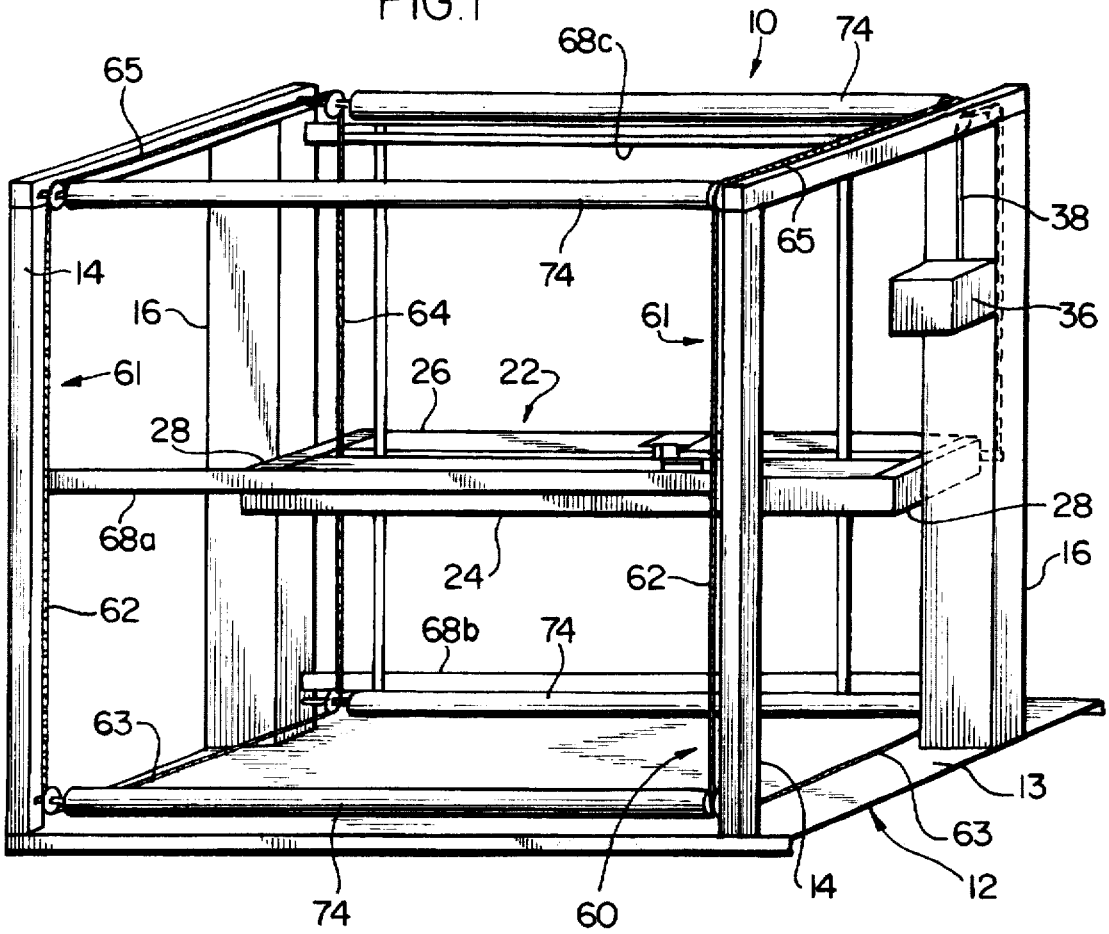
FIG. 1 is a perspective view of a stitching machine suited for operation according to the inventive method, where no external panels are illustrated for clarity of disclosure of the underlying operative components.
Figure 2:
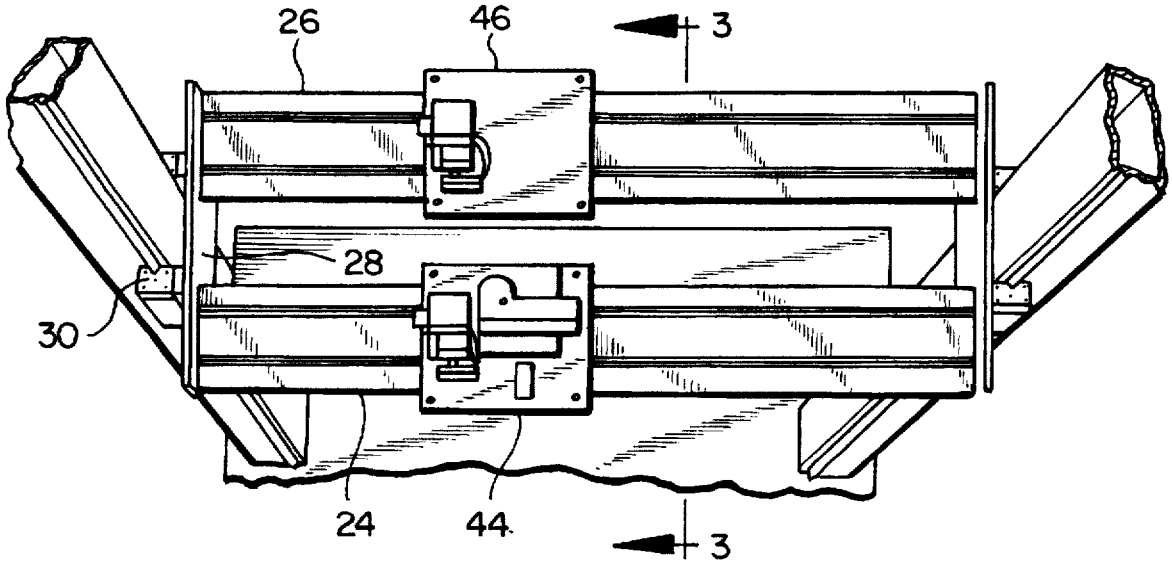
FIG. 2 is a perspective view of bridge structure of the stitching machine of FIG. 1, from a steeper viewing angle.

The specific stitching machine 10 to be disclosed now represents a preferred embodiment that will readily serve to operate according to the inventive method. For clarity and ease of disclosure, not all components or specific details of a component are illustrated in all figures where such might appear and be adequately illustrated in another figure; and conventional components may not be illustrated in precise details.

The stitching machine 10 has a frame 12 comprised of base 13 and front vertical side columns 14 and rear vertical side columns 16 upstanding from the base. A cross bridge 22 comprised of horizontally separated front and rear beams 24, 26 extended between end members 28 terminates proximate the rear vertical columns 16, and guide means 30 cooperate between the bridge end members 28 and rear vertical columns 16 to restrain the bridge 22 to move vertically along the rear side columns 16 with the bridge beams 24, 26 aligned generally horizontally. Drives 32 move the bridge end members 28 in precise unison vertically along the side columns 16, maintaining the bridge in horizontal alignment.

Counterweights 36 are guided vertically along the rear vertical columns 16 by conventional means (not shown), and cables 38 trained over pulleys near the top of the side columns 16 connect the counterweight and cross bridge together, to off-set the gravity bias of the bridge 22 during its vertical movement.

Mounting platforms 44, 46 are carried on the front and rear bridge beams 24, 26 respectively, and guide means 40 cooperate between the platforms and bridge beams to allow the platforms to be moved along the beam lengths generally between the bridge end members 28. Drives 42 are provided to move the platforms 44, 46 simultaneously in precise unison along the beams, maintaining them directly opposed to one another and horizontally aligned.

A separate drive 42 will be provided for each beam-platform, and in the embodiment illustrated includes a rack 43*a* secured to the beam and engaged by a pinion 43*b* driven by a gear motor 43*c* carried on the platform 44 or 46. The drives 32 for the bridge 22 can be similar, with separate racks secured to the different vertical rear side columns 16 and the pinions and gear motors being carried off of the opposite bridge end members 28.

Mounting platform 48 is carried on the front beam platform 44, and guide means 50 cooperate between the platforms 44, 48 to move the platform 48 only in the direction normal to the beam length and/or the movement of the platform 44 along the beam 24. A linear drive 52 such as an air cylinder connected between the platforms 44, 48 powers the platform 48 toward and away from the rear platform 46 when needed.

Figure 3:
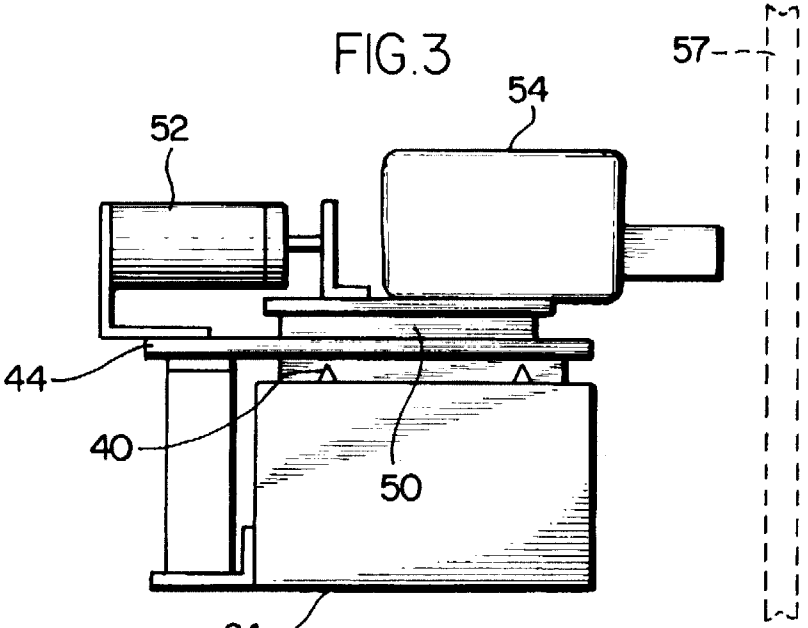
FIG. 3 is an enlarged sectional view as seen from lines 3—3 in FIG. 2.
Figure 5:
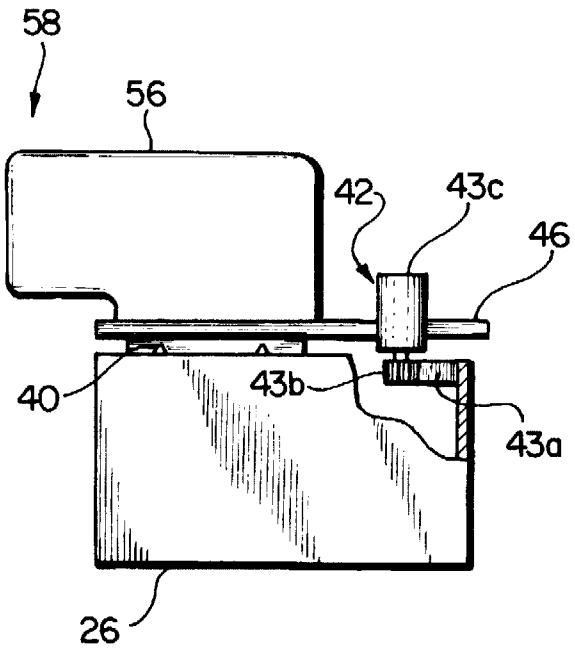
FIG. 5 is a side view of a conveyor cross bar and a typical sheet grip carried thereon.
Figure 5:
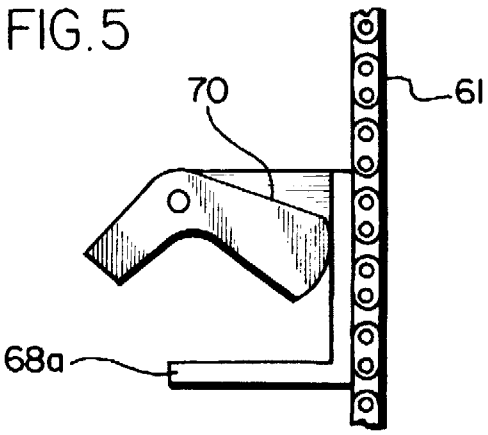
Figure 4:
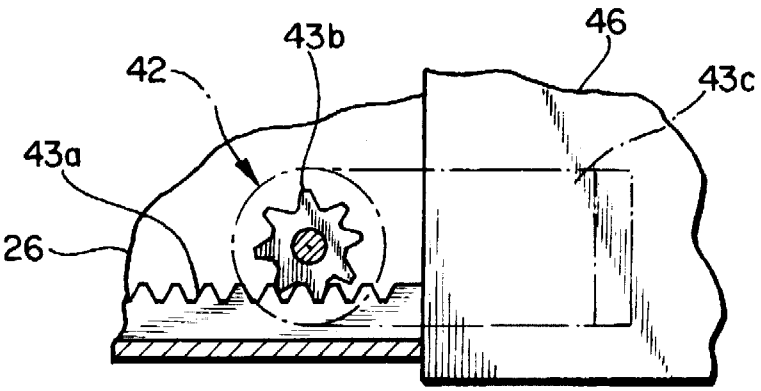
FIG. 4 is a top view of a platform drive used on the bridge structure of FIG. 3.

Cooperating components 54, 56 of a conventional sewing machine 58 are carried respectively on the front and rear beam mounting platforms 44 (via platform 48) and 46; the component 54 generally being the needle or head component and component 56 being the hook or base component of the sewing machine. The sewing machine needle and hook components 54, 56 are thus spaced apart horizontally as illustrated in FIG. 3 suited to allow the passage therebetween of flexible sheet(s) to be stitched (shown only in phantom as 57), and drive 52 allows movement of the needle component 54 horizontally toward and away from the hook component 56, suited when brought together to be in operative opposed and proximate cooperation for stitching through the sheet(s) 57 to form the intended interior patterned seams.

An endless loop conveyor system 60 is provided on the frame 12, having separated drive belts 61 extended as front and rear vertical runs 62, 64, and lower and upper horizontal runs 63, 65, with the plane defined by the rear vertical run 64 specifically passing between the opposed needle and hook sewing machine components 54, 56. Horizontal cross bar 68*a*, 68*b* and 68*c* are connected between the drive belts 61, each having clamps 70 thereon suited to grip and hold a stretched leading end of the flexible fabric sheet(s) to be stitched in the machine 10; before, during and even after such stitching. Horizontal rolls 74 are also mounted near the front and rear, and upper and lower corners between the directional conveyor runs 62, 63, 64, 65, to guide and/or support the carried sheet(s) around the loop corners. The rolls 74 can be powered to rotate at a peripheral speed corresponding to the travel speed of the conveyor system. Horizontally extended supports (not shown) can also be positioned under both the lower and upper horizontal loop runs 63, 65 for supporting the flexible sheet(s) passing such locations.

The effective vertical height of the rear conveyor run 64 exceeds the length of the fabric sheet(s) to be stitched, whereby the trailing portions of the fabric sheet(s) can suspend or hang vertically below the clamping cross bar 68*c* when near the top of the rear vertical conveyor run 64, including passing between the opposed needle and hook sewing machine components 54, 56. The width of the conveyor system, including the length of the clamp bars 68*a*, 68*b*, 68*c* exceeds the width of the flexible sheet(s) to be stitched.

Figure 6:
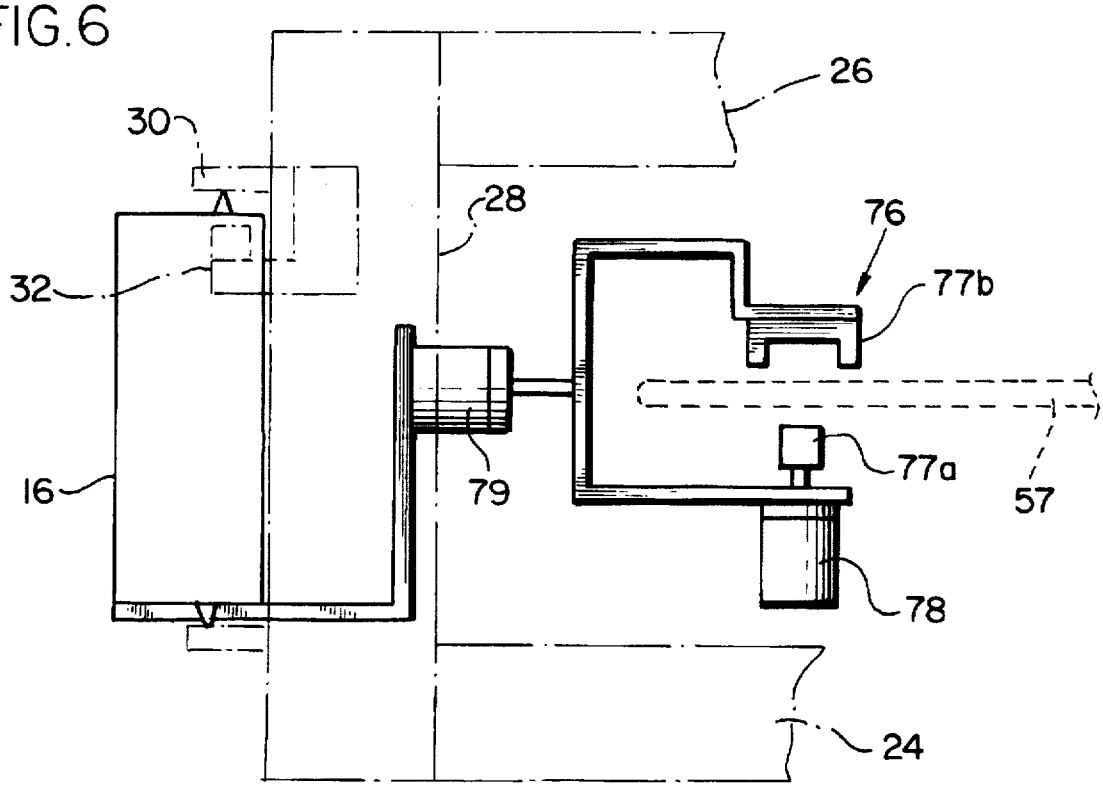
FIG. 6 is a top view of the bridge-side column mounting and drive, and of side clamp structure utilized in the stitching machine of FIG. 1.
Figure 7:
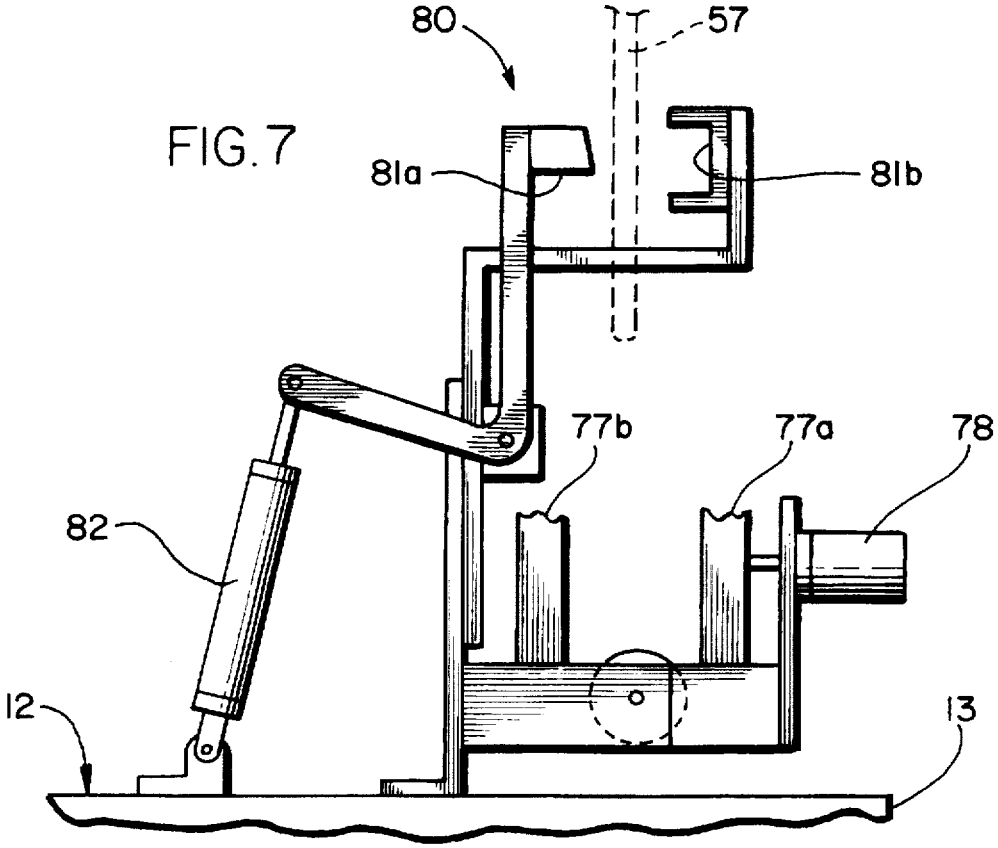
FIG. 7 is a side elevational view of part of the side clamp structure of FIG. 6, and of a bottom clamp structure utilized in the stitching machine of FIG. 1.

Side clamps 76 (FIGS. 6 and 7) are provided on the frame 12 to extend along the opposite sides of the rear vertical conveyor run 64, each clamp being comprised as elongated bars 77*a*, 77*b* horizontally separated and aligned to overlap opposite front and rear sides of the sheet(s) (in phantom as 57) as suspended from the cross bar 68*c*, extended also between the top leading and bottom trailing edges of the sheet(s). Linear drive or air cylinder 78 can be actuated to shift clamp bar 77*a* toward clamp bar 77*b*, to grip the vertical side edges of the sheet(s). Linear drive or air cylinder 79 can then be actuated to slightly separate the opposite side clamps horizontally in the plane of the suspended sheet(s) to stretch them tightly side-to-side. Bottom clamp 80 comprised of horizontally opposed bars 81*a*, 81*b* can further be provided on the frame 12 along the bottom trailing edge of the suspended sheet(s), with air cylinder 82 powering bar 81*a* transverse to the suspended sheet(s) to grip the bottom thereof. Once gripped, the conveyor system 60 can be inched vertically upward to stretch the sheet(s) tightly top-to-bottom or leading edge-to-trailing edge.

A preferred endless conveyor system overall loop length will slightly exceed three times the length of the flexible sheet(s) to be stitched, whereby three cross bars 68*a*, 68*b*, 68*c* can be provided equally spaced apart on the conveyor loop, each being advanced one-third of the way around the loop during the index cycle of the conveyor system. Further, the loop size can proportioned so that the positions of the three cross bars after each conveyor index will be positioned respectively as 68*a* at the front load position in the front vertical loop run 62, as 68*b* at a ready but pre-stitching position near the bend or juncture between the lower horizontal loop run 63 and the rear vertical run 64, and as 68*c* at the operative stitching position near the upper end of the rear vertical run 64.

The stretched leading end of the flexible sheet(s) to be stitched can be secured, manually or otherwise, to the conveyor cross bar at the 68*a* position stopped at a comfortable height spaced above the floor. One conveyor system index advances the cross bar to position 68*b*, carrying the leading end of the flexible sheet(s) with it, initially by moving the bar downwardly from the initial clamping position to the bottom of the front vertical run 62, and then rearwardly along the lower horizontal run 63 toward the rear vertical run 64. The next conveyor index upwardly advances the cross bar to the 68*c* position near the top of the rear vertical run 64. The stitched sheet(s) will be carried with the next conveyor index back to the 68*a* position.

With the disclosed stitching machine 10, one operator can easily remove a stitched sheet product from the clamp bar at position 68*a*, and then clamp another pre-stitched sheet(s) onto the same cross bar; while the immediately preceding cross bar 68*b* is in the ready position near the lower end of the loop run 54, while the next preceding cross bar 68*c* is at the top of the rear vertical run and its clamped sheet(s) might be stitched. As the typical stitching cycle for making the patterned seams on the sheet(s) can take between approximately one and even ten minutes, one operator likely will be able to simultaneously take care of several clustered stitching machines, moving from one machine to another, for greatly reduced labor costs for preforming such seam stitching. This can be contrasted against most conventional stitching machines that utilize a sheet frame and typically require one operator for each machine.

One important aspect of the disclosed stitching machine 10 and the incorporated method is that the pre-stitched flexible sheet(s) can be loaded directly onto the conveyor system 60 and then be carried thereby to suspend or dangle freely along a substantially vertical plane, whereupon the sheet(s) can be racked or stretched out along both the "X" and "Y" axes and secured along its peripheral edges in a pre-stitching condition; so that stitching of the sheet(s) can take place. This vertical orientation of the sheet(s) during stitching allows the front-to-rear horizontal space requirements or depth of the stitching machine to be significantly reduced, compared to commercially available stitching machines that stitch the sheet(s) supported in a horizontal plane by a sheet frame. Specifically, the overall front-to-rear horizontal space requirements or depth of the stitching machine itself can be reduced to possibly one-sixth or one-third the corresponding size of the smallest commercially used existing stitching machine.

Moreover, the distinctive stitching machine and method operates without a supplemental sheet frame for holding the sheet(s) during and after the stitching, and the needed floor space outside of the conventional stitching machine for racking the pre-stitched sheet(s) and removing the stitched sheet goods.

Additional specifics of the drives 32, 42 mentioned herein will now be discussed. Drives 32 must move the opposite ends of the bridge 22 vertically in precise unison, to keep the bridge 22 in horizontal alignment. Drives 42 must move the beam platforms 44, 46 in precise unison along the length of the bridge beams 24, 26, to provide that the sewing machine components 52, 54 remain in proper cooperation, exactly horizontally aligned and opposed to one another. To provide for this, the drives 32, 42 can include positive and accurate positional linkages having minimal free play, such as the illustrated precision rack and pinion drives, or with high tolerance ball screw mechanisms. Further, drives are to be controlled as part of servo mechanisms that use the position, direction of movement, or orientation of the components as process variables and detect any variance from set points or target values, and via feedback of the detected differences readjust the input to the drives. Servo mechanisms and controls of this type specifically are provided by Yaskawa Electric America, Inc. having offices at 2942 MacArthur, Northbrook, Ill. 60062, particularly suited for use in the disclosed stitching machine.

Further, the cooperating opposed needle head and base components of the sewing machine are maintained and operated in precise unison, both as to the speeds and positions of the components, by the use of such servo mechanisms and feedback controls, specifically including the use of master-slave interlock of the separate motors powering the separate respective components. This allows the controlled operation of the separate component motors while being separated on opposite sides of the sheet(s) during stitching, and without mechanical drive linkages between the motors.

Conventional photocell components (not shown) can be positioned adjacent the vertical rear run 64 of the conveyor system near the upper end thereof, suited to detect the leading edge of the gripped sheet(s) suspended from the clamp bar and to stop the conveyor advance or indexing as such approaches the proper stitching position. Once stopped, the bottom gripper mechanism 80 can be actuated to hold the trailing edge of the suspended sheet(s). Inched advancing movement of the conveyor can stretch the suspended sheet (s) vertically or along the "Y" axis. Actuation of the clamps 76 can grip the side edges of the suspended sheet(s), and of the drive 79 can stretch the sheet(s) horizontally or along the "X" axis. All of these racking steps can be carried out automatically by means of sensors and/or computer controls now used in the stitching machine art. Also, once the sheet(s) are suitable racked in the vertical orientation along the conveyor run 64, the sewing machine can be shifted automatically along the "X" and "Y" axes as needed via actuation of the respective drives 42 and 32 to trace out the intended seam pattern, again by using conventional computer controls now used in the stitching machine art.

While a specific embodiment has been illustrated, it will be obvious that minor changes could be made therefrom without departing from the spirit of the invention. Accordingly, the invention is to determined by the scope of the following claims.

What is claimed is:

1. A stitching machine for making interior seams through flexible sheet(s), comprising the combination of a sewing machine having cooperating needle and hook components;

a conveyor having a substantially vertical run passing between the cooperating sewing machine components, and of a height in excess of the sheet(s) to be stitched;

the conveyor having means thereon to releasibly retain the leading edge of the sheet(s), and to move said leading edge to near the upper end of said vertical run and thereby have the remainder of the sheet(s) hanging vertically therebelow along the conveyor run and between the sewing machine components;

means to releasibly retain the trailing and side edges of the sheet(s) while along the vertical conveyor run, and to stretch the sheet(s) along the vertical or "Y" axis and the horizontal or "X" axis to a generally flat stitchable condition;

means to shift the cooperating sewing machine components in unison along the "X" and "Y" axes as needed to trace out an intended seam pattern relative to the flexible sheet(s); and means to move said retained leading edge from said vertical conveyor run for removing the stitched sheet (s).

2. A stitching machine according to claim 1, further comprising the conveyor being an endless loop having a substantially uniform width greater than the width of the flexible sheet(s) to be stitched and having a length at least twice the height of the vertical run and defining in addition to the vertical run a second run not passing between the cooperating sewing machine components, and the conveyor having separate means thereon to releasibly retain the leading edges of different sets of the sheet(s) respectively at the vertical and second runs, whereby one set of flexible sheet(s) can be at the vertical run for being stitched while another set of flexible sheet(s) can simultaneously be at the second run for being retained on or removed from the conveyor.

3. A stitching machine according to claim 1, further comprising the conveyor being an endless loop having a substantially uniform width greater than the width of the flexible sheet(s) to be stitched and having a length slightly exceeding three times the height of the vertical run, and the conveyor having at substantially equal spacings around the loop separate means thereon to releasibly retain the respective leading edges of three sets of the sheet(s) simultaneously at substantially equal spacings around the loop, whereby the different sets of flexible sheet(s) can be respectively, being stitched, being retained on or removed from the conveyor, or waiting for being stitched or being removed.

4. A stitching machine according to claim 5, further comprising the conveyor endless loop being proportioned so that the positions of the separate means on the conveyor to releasibly retain the leading edge of the sheet(s), after each indexing of the conveyor loop, will be positioned respectively at a stitching position near the upper end of the vertical run, at a pre-stitching position near the lower end of the vertical run, and at an accessible comfortable height position spaced above the floor for retaining/removing the flexible sheet(s) relative to the conveyor.

5. A method of stitching interior seams through flexible sheets, comprising the combination of utilizing a sewing machine having separated but cooperating needle and hook components and orienting the components in generally horizontal alignment, holding the sheets along respective top edges thereof and elevating the top edges in a vertical direction to suspend the underlying remainder of the sheets in a general vertical orientation passing between the cooperating sewing machine components, holding the respective opposite side edges and the bottom edges of the sheets and biasing them apart for tensioning the sheets to a generally flat stitchable condition yet in the vertical plane, and moving the cooperating sewing machine components in unison along horizontal and vertical axes parallel to the vertical plane as needed to trace out and stitch the seams through the flexible sheets.

6. A method of stitching interior seams through flexible sheets according to claim 5, further comprising indexing the flexible sheets by the held top edges thereof in a horizontal direction and laterally of the vertical plane defined by the flexible sheets suspended between the cooperating needle and hook components of the sewing machine, toward the plane before having the seams stitched and away from the plane after having the seams stitched.

7. A stitching machine for making interior seams through flexible sheets of set lengths and widths, comprising the combination of spaced vertical side columns, a cross bridge extended between the side columns, and means connecting the cross bridge for movement vertically along the side columns;

said cross bridge comprising horizontally separated front and rear beams, mounting platforms and means connecting the mounting platforms for movement horizontally along the front and rear bridge beams respectively, and a component platform and means connecting the component platform for movement horizontally on one of the mounting platforms in the direction substantially normal to the bridge beams and toward and away from the other mounting platform;

a sewing machine having cooperating needle and hook components, the cooperating needle and hook components being connected to the other mounting platform and to the component platform and being horizontally separated and aligned and means to drive these platforms and the cooperative sewing machine components thereon horizontally as needed to be separated and to be in operative stitching proximity;

means to hold peripheral edges of the flexible sheets to be stitched and to stretch out the sheets to a generally flat stitchable condition vertically aligned and passing between the cooperating sewing machine components;

the maximum available vertical movement of the cross bridge along the side columns and the maximum available horizontal movement of the mounting platforms and sewing machine components carried thereon being in excess of the lengths and widths of the stretched flexible sheets as held and vertically aligned; and means to drive the cross bridge vertically along the side columns while maintaining the cross bridge in precise horizontal alignment, means to drive the mounting platforms and cooperative sewing machine components along the bridge beams in unison for maintaining the operative components in precise operative horizontal alignment, and means to operate these drive means as needed so as to shift the cooperating sewing machine components in unison along the horizontal and vertical axes and thereby trace out an intended seam pattern relative to the vertically aligned flexible sheets.

8. A stitching machine according to claim 7, further comprising counterweights connected to the cross bridge for off-setting the gravity bias of the cross bridge, and the platforms, sewing machine components, and drive means carried thereon, during vertical cross bridge movement along the vertical side columns.

9. A stitching machine according to claim 7, further comprising a conveyor having a vertical run aligned between the spaced vertical side columns and extended between the front and rear beams of the cross bridge, the conveyor having means thereon to releasibly retain the leading edge of the flexible sheets to be seamed and to move said leading edge to near the upper end of said vertical run and thereby have the remainder of the sheets suspended vertically therebelow along the conveyor run and between the sewing machine components, and said leading edge retaining means being part of said means holding the peripheral edges of the flexible sheets.

10. A stitching machine according to claim 9, further comprising the conveyor being an endless loop having a substantially uniform width greater than the width of the flexible sheet(s) to be stitched and having a length at least twice the height of the vertical run and defining in addition to the vertical run a second run not passing between the cooperating sewing machine components, and the conveyor having separate means thereon to releasibly retain the leading edges of different sets of the sheet(s) respectively at the vertical and second runs, whereby one set of flexible sheet(s) can be at the vertical run for being stitched while another set of flexible sheet(s) can simultaneously be at the second run for being retained on or removed from the conveyor.

11. A stitching machine according to claim 9, further comprising the conveyor being an endless loop having a substantially uniform width greater than the width of the flexible sheet(s) to be stitched and having a length slightly exceeding three times the height of the vertical run, and the conveyor having at substantially equal spacings around the loop separate means thereon to releasibly retain the respective leading edges of three sets of the sheet(s) simultaneously at substantially equal spacings around the loop, whereby the different sets of flexible sheet(s) can be respectively, being stitched, being retained on or removed from the conveyor, or waiting for being stitched or being removed.

12. A stitching machine according to claim 11, further comprising the conveyor endless loop being proportioned so that the positions of the separate means on the conveyor to releasibly retain the leading edge of the sheet(s), after each indexing of the conveyor loop, will be positioned respectively at a stitching position near the upper end of the vertical run, at a pre-stitching position near the lower end of the vertical run, and at an accessible comfortable height position spaced above the floor for retaining/removing the flexible sheet(s) relative to the conveyor.

13. A stitching machine according to claim 12, further comprising counterweights connected to the cross bridge for off-setting the gravity bias of the cross bridge, and the platforms, sewing machine components, and drive means carried thereon, during vertical cross bridge movement along the vertical side columns.

* * * * *